US007114411B2

(12) United States Patent
Willemsen

(10) Patent No.: US 7,114,411 B2
(45) **Date of Patent: *Oct. 3, 2006**

(54) PEDAL ADJUSTER

(75) Inventor: Larry G. Willemsen, Morpeth (CA)

(73) Assignee: KSR Industrial Corporation, Southfield, MI (US)

( * ) Notice: Subject to any disclaimer, the term of this patent is extended or adjusted under 35 U.S.C. 154(b) by 111 days.

This patent is subject to a terminal disclaimer.

(21) Appl. No.: 10/143,488

(22) Filed: May 9, 2002

(65) Prior Publication Data

US 2002/0166408 A1 Nov. 14, 2002

Related U.S. Application Data

(60) Provisional application No. 60/289,723, filed on May 9, 2001.

(51) Int. Cl.
*G05G 1/14* (2006.01)

(52) U.S. Cl. ..... 74/512; 74/560

(58) Field of Classification Search ..... 74/512, 74/560

See application file for complete search history.

(56) References Cited

U.S. PATENT DOCUMENTS

| | | | | |
|---|---|---|---|---|
| 4,470,570 | A | 9/1984 | Sakurai | 244/235 |
| 4,528,590 | A | 7/1985 | Bisacquino et al. | 338/153 |
| 4,883,037 | A | 11/1989 | Mabee et al. | 123/399 |
| 4,915,075 | A | 4/1990 | Brown | 123/399 |
| 4,938,304 | A | 7/1990 | Yamaguchi et al. | 180/197 |
| 4,958,607 | A | 9/1990 | Lundberg | 123/399 |
| 4,969,437 | A | 11/1990 | Kolb | 123/399 |
| 4,986,238 | A | 1/1991 | Terazawa | 123/361 |
| 5,056,742 | A | 10/1991 | Sakurai | 244/235 |
| 5,063,811 | A | 11/1991 | Smith et al. | 74/513 |
| 5,215,057 | A | 6/1993 | Sato et al. | 123/400 |
| 5,233,882 | A | 8/1993 | Byram et al. | 74/514 |
| 5,241,936 | A | 9/1993 | Byler et al. | 123/399 |
| 5,385,068 | A | 1/1995 | White et al. | 74/512 |
| 5,460,061 | A | 10/1995 | Redding et al. | 74/512 |
| 5,632,183 | A | 5/1997 | Rixon et al. | 74/512 |
| 5,771,752 | A | 6/1998 | Cicotte | 74/512 |
| 5,819,593 | A | 10/1998 | Rixon et al. | 74/514 |
| 5,884,532 | A | 3/1999 | Rixon et al. | 74/512 |
| 5,887,488 | A | 3/1999 | Riggle | 74/514 |
| 5,927,154 | A | 7/1999 | Elton et al. | 74/512 |
| 5,996,438 | A | 12/1999 | Elton | 74/512 |

(Continued)

FOREIGN PATENT DOCUMENTS

DE 1 975 7084 6/1999

(Continued)

OTHER PUBLICATIONS

'74 General Motors Service Manual 5-10:5-17.

*Primary Examiner*—Chong H. Kim
(74) *Attorney, Agent, or Firm*—Gifford, Krass, Groh, Sprinkle, Anderson & Citkowski, P.C.

(57) ABSTRACT

A pedal adjuster for adjusting the position of pedals within a vehicle. The pedal adjuster assembly includes a frame member mounted to a support and a pedal arm pivotally mounted to the frame. The frame includes a pair of sides having slots to receive a clevis. The pedal arm is mounted between the sides and mounted to the clevis. A screw rod is actionable to move the pedal arm with respect to the frame to adjust the position of the pedal arm. The pedal arm angles forwardly and downwardly from the pivot point to adjust the pedal through a arc having a relatively linear adjustment path.

6 Claims, 2 Drawing Sheets

U.S. PATENT DOCUMENTS

| | | | | |
|---|---|---|---|---|
| 6,019,015 | A | 2/2000 | Elton | 74/513 |
| 6,073,515 | A | 6/2000 | Elton et al. | 74/564 |
| 6,109,241 | A | 8/2000 | Engelgau | 123/399 |
| 6,151,984 | A | 11/2000 | Johansson et al. | 74/512 |
| 6,151,986 | A | 11/2000 | Willemsen et al. | 74/512 |
| 6,173,625 | B1 | 1/2001 | McFarlane et al. | 74/512 |
| 6,178,847 | B1 | 1/2001 | Willemsen et al. | 74/512 |
| 6,289,761 | B1 | 9/2001 | Reynolds et al. | 74/512 |
| 6,289,763 | B1 | 9/2001 | Rixon et al. | 74/514 |
| 6,305,239 | B1 | 10/2001 | Johansson et al. | 74/512 |
| 6,321,617 | B1 | 11/2001 | Schwyn | 74/512 |
| 6,367,349 | B1 * | 4/2002 | Allen et al. | 74/512 |
| 6,374,695 | B1 | 4/2002 | Johansson et al. | 74/512 |
| 6,389,927 | B1 | 5/2002 | Willemsen | 74/514 |
| 6,431,021 | B1 * | 8/2002 | Djordjevic et al. | 74/512 |
| 6,516,683 | B1 * | 2/2003 | Sundaresan et al. | 74/560 |
| 6,584,871 | B1 * | 7/2003 | Burton et al. | 74/512 |
| 6,609,438 | B1 * | 8/2003 | Bigham et al. | 74/560 |

FOREIGN PATENT DOCUMENTS

| | | |
|---|---|---|
| EP | 0 918 273 | 5/1999 |
| FR | 95 12130 | 4/1997 |

* cited by examiner

PEDAL ADJUSTER

RELATED APPLICATION

This application claims priority of U.S. Provisional Patent Application 60/289,723 filed May 9, 2001, which is incorporated herein by reference.

BACKGROUND OF THE INVENTION

Pedal adjusters are used in vehicles to adjust the position of a pedal arm and pedal with respect to a driver's foot. The pedal arms are connected to rods or cables which are moved by the pedal arm to actuate the brakes or the throttle. Most pedal adjusters are designed to adjust the pedal position without changing the position of the terminus of the rod or cable which is to be moved by the pedal arm. Accordingly, it is known to mount the terminus to an adjuster bracket disclosed in U.S. Pat. No. 4,989,474. The position of the terminus remains unchanged during adjustment of the pedal arm position. However, the pedal is adjusted through an arc which has a verified vector which increases during adjustment. Thus, as the pedal moves rearwardly, it also moves increasingly upwardly. This results in the pedal being too far from the floor at the full rearward adjustment. The adjuster bracket mechanism is complicated and a great amount of space is used by the structure.

SUMMARY OF THE INVENTION

A compact adjustment mechanism for adjusting the position of a pedal arm of a vehicle includes a frame having a pair of sides. The frame is pivotally mounted to a support. The pedal arm is mounted by a pin to hang between the sides of the frame. A drive mechanism including a screw rod is mounted to the frame. The screw rod extends between the sides to a clevis connected to the pedal arm. The clevis is guided in slots in the sides. The drive mechanism is operable to rotate a worm having a threaded aperture to adjust the position of the pedal arm within the frame. The pedal arm angles downwardly and forwardly from the pin to a connection point for the clevis. From there, the pedal arm is angled downwardly and rearwardly to the pedal. The pedal is adjusted along an arc having a center which is positioned rearwardly from the axis of rotation of the frame about the support. Thus is provided an adjustment mechanism which has a low vertical rise during adjustment. Other objects and advantages of the invention will be readily appreciated by reference to the following detailed description when considered in connection with the accompanying drawings which illustrate the preferred embodiment.

DETAILED DESCRIPTION OF THE PREFERRED EMBODIMENT

Figure 1:
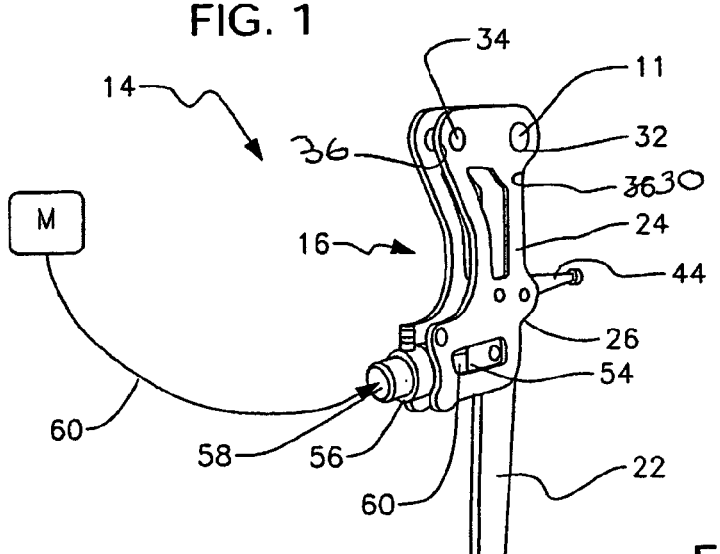
FIG. 1 is a side perspective view of the adjustment mechanism in accordance with the invention.
Figure 2:
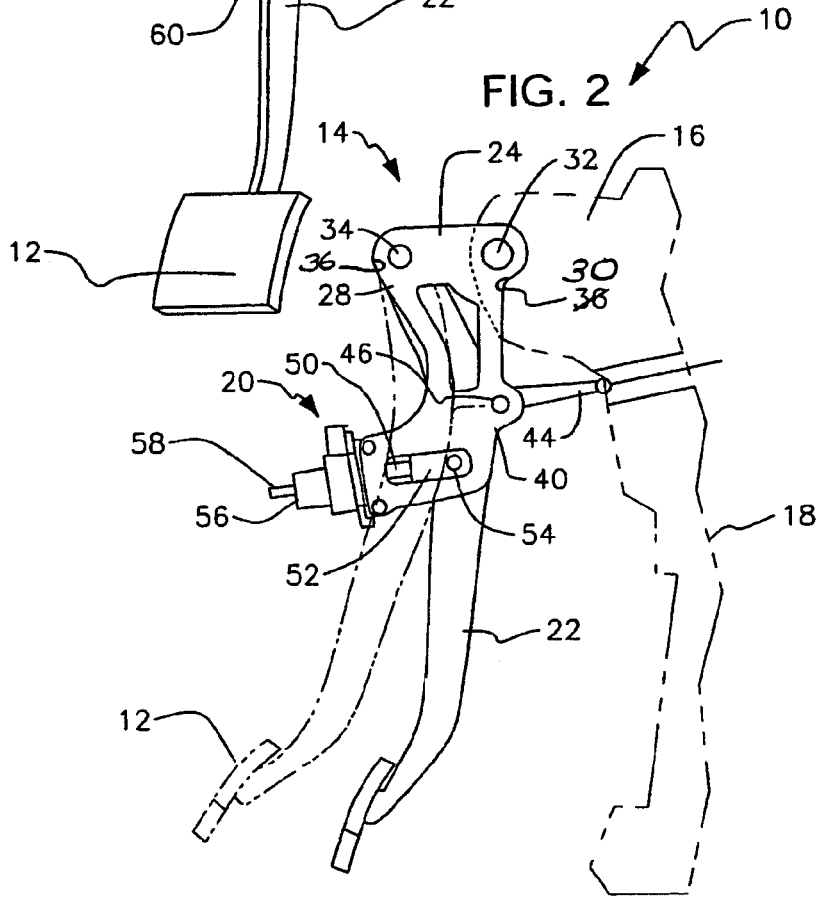
FIG. 2 is a side view of the adjustment mechanism in accordance with the invention.

A novel adjustable pedal apparatus 10 for adjusting the position of a pedal 12 within a vehicle is shown in FIGS. 1 and 2. The pedal 12 is adjusted along a plane which extends longitudinally from front to back of the vehicle. Directional terms such as front, "forwardly" or rear, "rearwardly" are used in respect to the vehicle. The adjustable pedal apparatus 10 includes a pedal adjuster assembly 14 mounted to a support 16. The support 16 is fixed to a fire wall 18 of a vehicle as known in the art. The pedal adjuster 14 assembly includes a pedal arm 22, a frame 24 and a drive mechanism 20. The pedal arm 22 is mounted between a pair of spaced apart sides 26 of the frame 24. The sides of the frame 24 are generally rectangular. The frame 24 is mounted to the support 16 by a pin 32 defining a frame pivot axis. The pin 32 is received in apertures located at a top 28 of frame 24 adjacent a front edge 30. The pedal adjuster assembly 14 pivots about the frame pivot axis when displaced during operation of the pedal 12. The pedal arm 22 is mounted to the top 28 by a pin 34 defining a pedal arm pivot axis and positioned adjacent a rear edge 36 of the frame 24. An ear 40 extends from the front edge 30 of each side 26 for connecting a terminus of a control such as a conventional brake rod 44 pivotally mounted to the ears 40 by a pin 46.

As shown in FIG. 2, the drive mechanism 20 includes a screw rod 50 having a threaded portion connected to a gear mechanism and a clevis 52 connected to the pedal arm 22. The clevis 52 is attached to the pedal arm 22 by a pin 54 at one end and pivotally connected to the screw rod 50 at another end. The clevis 52 is guided in slots 42 formed in the sides 26 of the frame 24. The gear mechanism includes a housing 56, a worm and a worm gear (not shown) as disclosed in U.S. Pat. No. 6,151,986 and incorporated by reference. The gear mechanism 48 is mounted to the rear edges 36 at the bottom of the frame. The worm has a threaded aperture for receiving the screw rod 50. The worm gear is connected to a drive coupling 58 which is connected to a drive cable 60. The drive cable extends between the coupling 58 and a remote motor M.

Actuation of the motor M rotates the cable 60 to rotate the drive worm to move the screw rod 50 and clevis 52. The clevis 52 moves in the slots 42 to pivot the pedal arm rearwardly or forwardly depending upon the direction of the rotation of the motor to adjust the position the pedal 12 at a desired location.

In the present embodiment the motor M is remotely mounted, such as beneath the instrument console. However, the motor may be mounted directly to the frame to turn the drive mechanism 20 or another pedal assembly.

Figure 3:
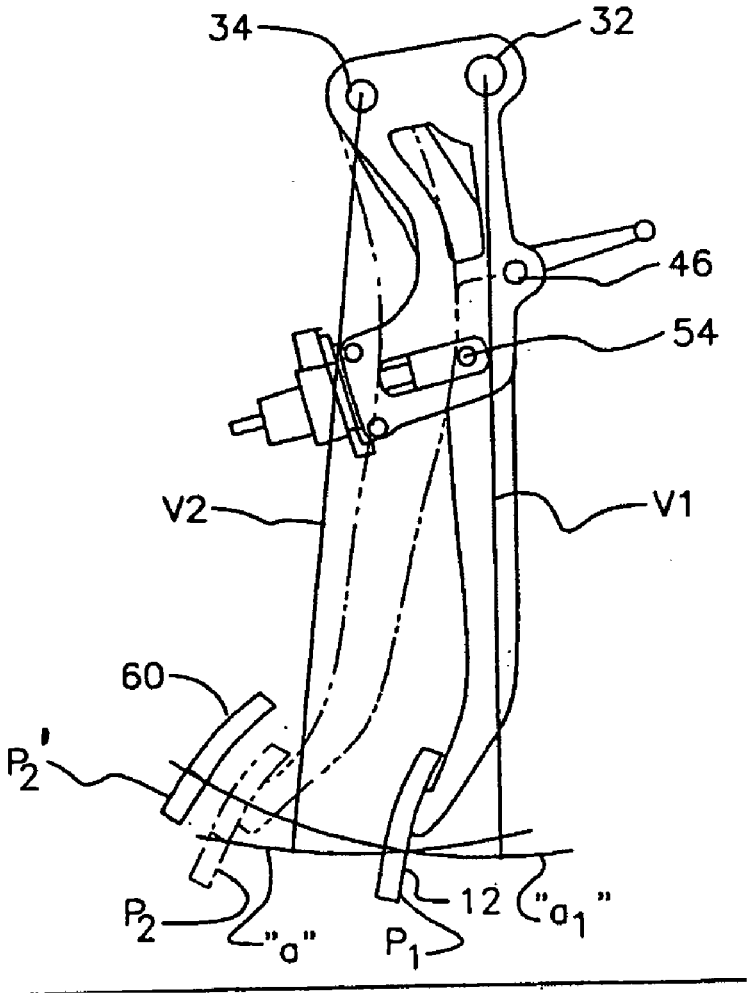
FIG. 3 is a schematic diagram comparing movement of the pedal arm during adjustment with the pedal arm adjusted from the pivot point of the support.

The pedal arm 22 angles downwardly and forwardly from the pivot pin 34 defining the pedal arm pivot axis to the attachment pin 54 for the clevis 52. The pin 54 is located generally beneath the frame pivot axis at pin 32. The pedal arm extends downwardly to the pedal 12 such that the pedal is located in a position generally the same as if the pedal arm were mounted directly to the support as a conventional non-adjustable pedal arm. The shape of the pedal arm keeps the adjustment mechanism and housing from extending rearwardly into the area occupied by the driver but facilitates movement of the pedal through an arc centered at the pin 34 point. As shown in FIG. 3, the pedal 12 pivots through a lower portion of an arc "a" centered beneath the pivot pin 34 rather than outwardly and upwardly as with for pedal 60. Pedal 60 pivots about the support through an arc "a'" from $P_1$ to $P_2'$. As can be seen, pedal 60 starts from the same position as pedal 12 but is farther from the floor at $P_2'$ than pedal 12 at $P_2$. Thus, the pedal adjustment assembly 14 prevents the pedal from getting too far from the floor 62 when moved rearwardly.

Thus disclosed is a compact pedal adjustment arrangement which provides for the adjustment of the pedal utilizing a minimum amount of space.

Having described my invention, however, many modifications thereto will become apparent to those skilled in the art to which it pertains without deviation from the spirit of the invention as defined by the scope of the appended claims.

I claim:

1. An adjustable pedal apparatus for a vehicle comprising:

a support mounted to said vehicle;

a pedal adjuster assembly having a frame mounted to said support to pivot about a frame pivot axis, wherein said frame pivot axis is positioned at a top portion of said frame;

a one-piece pedal arm pivotally mounted to said frame to pivot about a pedal arm pivot axis, wherein said pedal arm pivot axis is positioned at a top portion of said frame and is spaced apart in a rearward direction from said frame pivot axis;

said pedal arm having an upper portion extending forwardly and downwardly from said pedal arm pedal axis to a connection point which is positioned below said frame pivot axis and said pedal arm pivot axis; and a drive mechanism mounted to a rear edge of said frame, said drive mechanism having a screw rod connected to said pedal arm at said connection point.

2. The adjustable pedal apparatus of claim 1, wherein said frame member has a pair of sides.

3. The adjustable pedal apparatus of claim 2, wherein said drive mechanism comprises a mechanism comprising a clevis connecting said screw rod to said pedal arm.

4. The adjustable pedal apparatus of claim 3, wherein said clevis is guided in a slot in each of said sides.

5. The adjustable pedal assembly of claim 2, wherein said pedal arm is mounted between said pair of sides.

6. An adjustable pedal apparatus for a vehicle comprising:

a support mounted to said vehicle;

a pedal adjuster assembly having a frame mounted to said support to pivot about a frame pivot axis, wherein said frame member has a pair of sides and said frame pivot axis is positioned at a top portion of said frame member between said pair of sides;

a one-piece pedal arm pivotally mounted to said frame to pivot about a pedal arm pivot axis, wherein said pedal arm pivot axis is positioned at a top portion of said frame and is spaced apart in a rearward direction from said frame pivot axis;

said pedal arm having an upper portion extending forwardly and downwardly from said pedal arm pedal axis to a connection point which is positioned below said frame pivot axis and said pedal arm pivot axis; and a drive mechanism mounted to a rear edge of said frame, said drive mechanism having a screw rod connected to said pedal arm at said connection point, wherein said drive mechanism includes a clevis connecting said screw rod to said pedal arm, and said clevis is guided in a slot in each of said pair of sides.

* * * * *